United States Patent [19]

Winthaegen

[11] 4,183,658

[45] Jan. 15, 1980

[54] COPYING APPARATUS WITH IMAGING BELT AND IMAGE TRANSFER VIA AN INTERMEDIATE SUPPORT

[75] Inventor: Leon M. W. Winthaegen, Maasbree, Netherlands

[73] Assignee: Océ-van der Grinten N.V., Venlo, Netherlands

[21] Appl. No.: 935,939

[22] Filed: Aug. 23, 1978

[30] Foreign Application Priority Data

Aug. 29, 1977 [NL] Netherlands ..... 7709486

[51] Int. Cl.[2] ..... G03G 15/00

[52] U.S. Cl. ..... 355/3 BE; 355/16

[58] Field of Search ..... 355/3 BE, 3 TR, 3 R, 355/16; 96/1.4

[56] References Cited

U.S. PATENT DOCUMENTS

| | | | |
|---|---|---|---|
| 3,846,021 | 11/1974 | Vola | 355/16 |
| 4,068,937 | 1/1978 | Willemse et al. | 355/16 X |
| 4,095,886 | 6/1978 | Koeleman et al. | 96/1.4 X |

*Primary Examiner*—R. L. Moses

*Attorney, Agent, or Firm*—Albert C. Johnston

[57] ABSTRACT

In a copying apparatus of the type employing a moving image-carrying belt from which an image is transferred to an intermediate support during the action of a device for pressing the belt against and advancing it with intermediate support, which is moved at a speed slightly lower than the speed at which the belt is driven, lengths of the belt leading to and from the belt pressing device are engaged by respective floating rollers which apply first and second forces tensioning the belt. The second tensioning force is kept greater than the first, thus acting when the pressing device is inactive to displace upward the belt lead to the pressing device, and an arrest device limits the upward displacement.

8 Claims, 2 Drawing Figures

Figures 1, 2:
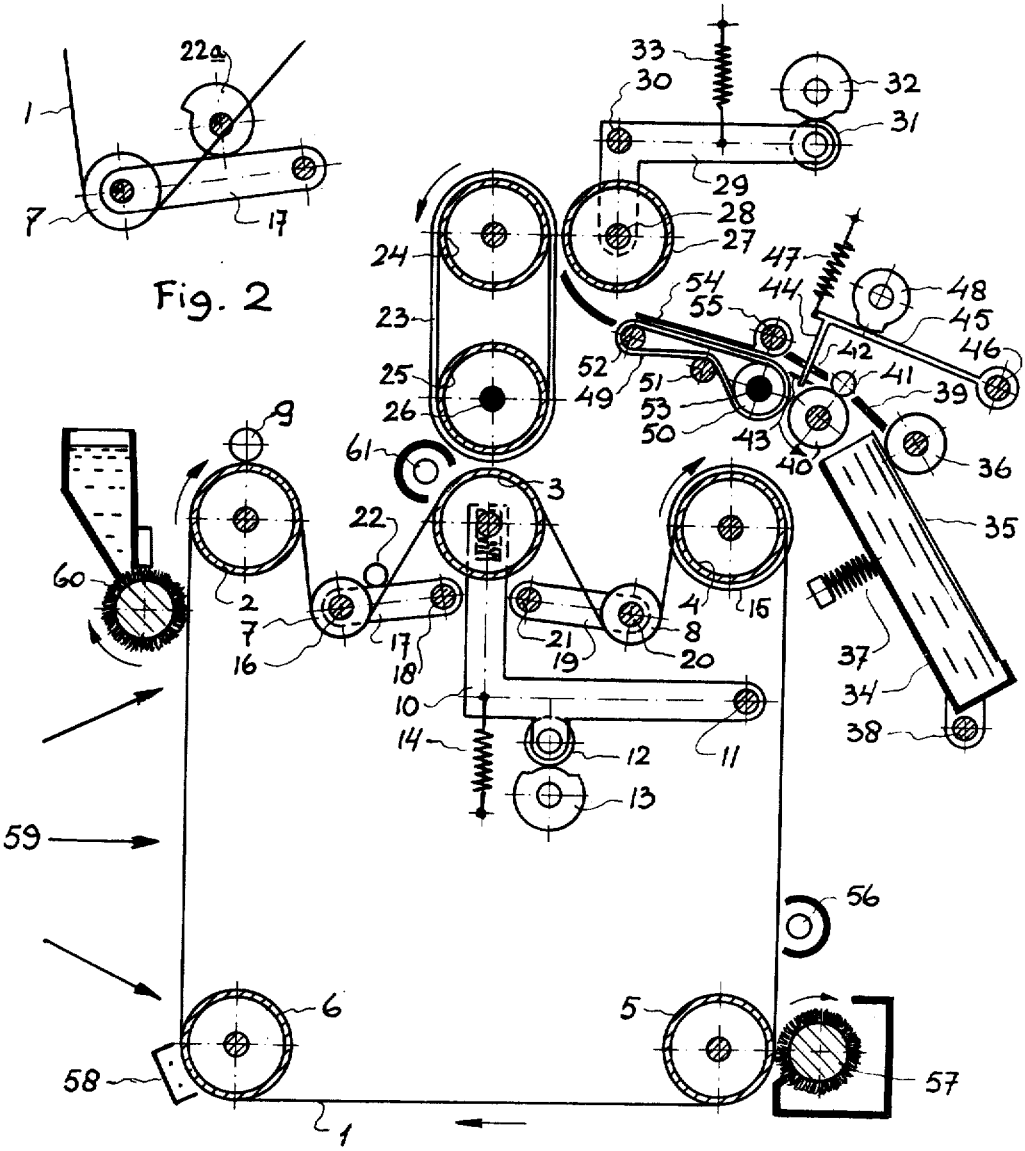

COPYING APPARATUS WITH IMAGING BELT AND IMAGE TRANSFER VIA AN INTERMEDIATE SUPPORT

This invention relates to copying apparatus of a type in which images formed on a moving photoconductive belt are transferred to an intermediate support, which typically is a second moving belt, and subsequently are transferred to copy material brought into contact with the intermediate support.

A known copying apparatus of that type is described in U.S. Pat. No. 4,068,937. This known apparatus comprises a belt which is moved forward by a drive roller toward a belt guiding device, means for forming images on the belt, an intermediate support which is moved forward with a speed slightly lower than the speed of the image carrying belt, and a first pressure device by which a lead of that belt between the drive roller and the guiding device can be brought into pressure contact with the intermediate support in order to transfer images from the belt to the intermediate support, during which contact, under the friction then occurring, the belt locally accepts the speed of the intermediate support. The known apparatus further is provided with means for supplying copy material to the intermediate support and a second pressure device for contacting the copy material under pressure with the intermediate support in order to transfer the images from the latter onto the copy material, and with control means which synchronize the operation of the copy material supply means with operations of the pressure devices.

In said known apparatus, a sagging loop is present in the imaging belt at a location between the first pressure device and the guiding device. When this pressure device is activated, it causes the speed of the belt movement at the place of the pressure contact to become equal to the speed of the intermediate support. Consequently, this sagging loop becomes smaller and a second sagging loop is formed ahead of the contact zone. Subsequently, upon inactivation of the pressure device, the second sagging loop is tightened by the belt driving action of a driven smooth auxiliary roller, whereupon the first sagging loop regains its original dimensions.

Although excellent practical results generally can be obtained with the known apparatus, it may occur in its use that the formation of the slack, or sagging loops, in the imaging belt does not always take place spontaneously in exactly the same way. When variations of the belt slack, or loop formations, occur they can adversely affect the uniformity of the belt movement and, consequently, the image quality of the copies produced. Moreover, the auxiliary roller, which at all times slips over the rear side of the belt, may cause objectionable wear of the belt.

The object of the present invention is to provide an improved copying apparatus by which the above mentioned disadvantages of the known apparatus can be eliminated.

For this purpose, according to the invention, in an apparatus of the type above mentioned the belt lead between the drive roller and the first pressure device is guided over a first floating, or dancing, roller which exerts a first force tensioning the web; the belt lead between the first pressure device and the guiding device is guided over a second floating, or dancing, roller which exerts a second belt tensioning force that is greater than the first belt tensioning force; and the displacement of the floating rollers is limited by a suitably positioned stop or arrest device.

As a result of the utilization of the floating rollers, the portions of the belt which form the sagging loops are kept tensioned so that the tension variations that occur suddenly upon the activation and inactivation of the first pressure device are limited and kept substantially uniform. Furthermore, the sagging portions of the belt follow the same path at all times, and this makes it practicable to install along these portions of the belt or in their vicinity auxiliary processing devices, such for instance as exposure lamps, which must be positioned exactly at a certain, proper distance from the belt.

According to a further feature of the invention, the arrest device is arranged to cooperate with the first floating roller and is itself made displaceable so that the size of the loop formed in the photoconductive belt by the first floating roller can be varied by adjusting the position of the arrest device. Since a variation of the size of this loop alters the length of belt present between an image on the belt and the zone of action of the first pressure device at the movement when the first pressure device is activated, the position which the image will occupy on the copy material can be adjusted by adjusting the position of the arrest device. Consequently, the image and the copy material can be brought in register simply by displacing the arrest device.

The invention and its advantages will be further understood from the following description and the accompanying drawings of illustrative embodiments of the invention. In the drawings:

FIG. 1 is a schematic sectional view of a preferred embodiment of copying apparatus according to the invention; and FIG. 2 is a schematic view of an embodiment of an adjustable arrest device for the first floating roller of the apparatus.

As illustrated in FIG. 1, an endless photoconductive belt 1 extends through a path in which it is tensioned over a continuously rotating drive roller 2, a pressure roller 3, guide rollers 4, 5 and 6, and floating rollers 7 and 8 which engage respective sagging loops of the belt in leads thereof extending between the rollers 2 and 3 and the rollers 3 and 4. With the aid of narrow rollers 9 which engage only edge portions of the belt, the belt 1 is kept in contact with the surface of the drive roller 2, which surface is preferably made of rubber. By rotation of the roller 2 the belt 1 is driven at a desired speed which, for instance, may be a speed of 20 meters per minute.

The pressure roller 3 is freely rotatable in supporting bearings provided in arms 10 which can swivel about the axis of a shaft 11. The arm 10 shown in the drawing is provided with a cam follower 12 which cooperates with a cam 13 rotatably supported in bearings. Springs 14 exercise a pulling force on the arms 10, so that cam follower 12 is continuously kept in contact with roller 13.

The guide roller 4 is continuously driven in the direction indicated by an arrow at a circumferential speed slightly lower than the speed of movement of belt 1, for instance at a circumferential speed of 19.8 m/minute when the belt is driven by roller 2 at a speed of 20 m/min. Because of the difference in speed, the belt 1 slips over the surface of roller 4. As a result of this slipping and with the aid of guide plates 15 which are provided on roller 4 at each side of the belt the belt 1 is kept aligned with the desired path of its travel; all this being in accord with the principle described in the Netherlands Pat. No. 148,418.

The guide rollers 5 and 6 are freely rotatable in supporting bearings. The floating roller 7 is constituted by two narrow discs which engage only with the edges of belt 1 and are freely rotatable on supporting bearings on a rod 16. The rod 16 is fixed to arms 17 with which it forms a rigid unit that can swivel about the axis of a shaft 18.

The floating roller 8 also comprises two narrow discs which engage only with the edges of the belt 1. These discs are freely rotatable on supporting bearings on a shaft 20 which at its opposite ends is supported in bearings in arms 19. The arms 19 are supported pivotably and independently of each other in bearings on a shaft 21.

The rollers 7 and 8 exert tensioning forces on the belt 1 by their weight. The second floating roller 8, as by being made heavier than the roller 7, exerts a greater force on the belt than roller 7. Consequently, roller 7 is subjected to an upwardly directed force by which the arms 17 are normally kept in an upward position where one of them abuts against an arrest device 22.

An intermediate image support shown as an endless belt 23 is arranged above the pressure roller 3. Belt 23 is provided with a thin top layer made of soft silicone rubber. The belt 23 is driven in the direction of the arrow by a drive roller 24 at a speed slightly lower than that of belt 1. This speed, for instance, amounts to 19.8 m/min. when roller 2 drives belt 1 at a speed of 20 m/min. Beyond roller 24 the belt 23 passes over a guide roller 25 which is freely rotatable in supporting bearings. The roller 25 comprises a rigid hollow cylinder having arranged axially inside it a heating element 26 by which the cylinder of roller 25 is heated, and consequently also the belt 23 running in contact with its surfact. By the use of control means of kinds generally known the energy supply to heating element 26 is regulated so that the temperature at the surface of belt 23 is constantly kept elevated sufficiently to soften the particles of a powder image transferred to this surface. This temperature, for instance, amounts to about 105° C.

At one side of the drive roller 24, at a location where the belt 23 is supported against this roller, a second pressure roller 27 is supported in bearings for free rotation about the axis of a shaft 28 which is connected with arms 29 and with these arms forms a rigid unit that is supported pivotably in bearings on a shaft 30. One of the arms 29, as shown in the drawing, carries at its end a freely rotatable cam follower roller 31 which cooperates with a rotatable cam 32. Springs 33 exert pulling forces on the arms 29 and thus keep the cam follower 31 continuously in contact with cam 32.

The illustrated apparatus further includes a copy paper supply system which comprises a tray 34 for receiving a pile 35 of paper sheets. A friction roller 36 is provided opposite the base of tray 34 for engaging with the top of the pile 35 and feeding sheets away from the pile one after another. The tray 34 is pivotable about the axis of a shaft 38, and its base is pressed by a spring 37 in such manner that the top sheet of a pile in the tray is always held against roller 36 with a predetermined pressure.

A sheet fed away from pile 35 is guided by a guide plate 39 into the nip between a continuously rotated roller 40 and a roller 41 constituted by discs that rest edgewise and rotate freely on roller 40. Located beyond the nip between rollers 40 and 41 are two guide plates 42 and 43 which are spaced apart to provide a sheet passageway.

Stop members 44 normally extend into this passageway across the path of a sheet passed into it between the rollers 42 and 43.

These stop members protrude from arms 45 fixed on a shaft 46 supported pivotably in bearings. One of the arms 45, as shown in the drawing, is held continuously in contact with a cam 48 by the force of a spring 47; and the cam 48 is supported rotatably in bearings so that, upon rotating it, the stop members 44 are moved into and out of their sheet stopping position in the passageway.

Beyond the guide plates 42 and 43 there is an endless belt 49 which is trained over freely rotatable rollers 50 and 51 and over a continuously rotating drive roller 52. Roller 52 drives belt 49 with a speed as high as or slightly higher (for instance 5% higher) than the speed of movement of belt 23. A heating element 53 is provided inside roller 50 for heating its cylindrical shell and consequently also the belt 49 running in contact with its surface. By the use of conventional control means (not shown) the energy supply to element 53 is regulated so that the temperature of the surface of belt 49 is constantly kept at a predetermined level suitable for preheating the sheets being fed along the upper flight of the belt 49, for instance, at a temperature of 105° C. A flexible pressure plate 54 made of a material having little surface friction, for instance of polytetrafluoroethylene, is fixed to a shaft 55 pivotably supported in bearings so that this plate will rest on the belt 49 and will press a sheet against it as the sheet is being fed to receive an image.

Means of known kinds are provided at suitable locations along the path of the belt 1 in order to form powder images on the photoconductive surface of this belt by the xerographic process. These means typically comprise a light source 56 by which any charges present on belt 1 are removed; a cleaning brush 57 by which any powder residues present on belt 1 are removed; a corona charging device 58 by which a uniform electrostatic charge is applied to belt 1; a projection station 59 where, in a manner known per se so not illustrated, a light image of an original lying on an original exposure plate is projected onto belt 1 with the aid of flash lamps, mirror(s) and an objective, thus forming an imagewise charge pattern in the photoconductive layer on belt 1, a magnetic brush developing device 60 by which the charge pattern on belt 1 is developed into a powder image; and a light source 61 by which belt 1 is radiated for reducing the adhesion between the image powder and belt 1.

Finally, the apparatus is provided with control means, not illustrated, by which the operation of the above mentioned image forming means 56–61 is synchronized with the operation of cam 13, cam 32, friction roller 36 and cam 48. Control systems suitable for this purpose are known in various kinds and embodiments among which, for instance, is the embodiment of such a control system disclosed in U.S. Pat. No. 3,912,390.

A powder image is formed on belt 1 by successively charging, imagewise exposing and developing an area of the belt moved past the stations at 58, 59 and 60. When this imaged area of the belt approaches pressure roller 3, cam 13 is rotated through an arc of 180° in response to a signal emitted by a control system, thus displacing the arms 10 and roller 3 in upward direction so that roller 3 presses the belt 1 against a portion of belt 23 supported on roller 25. As a result of the friction then occurring at the zone of contact between the two belts, belt 1 accepts the slightly lower speed of belt 23. Since belt 1 is driven constantly by roller 2 at a slightly higher speed, the belt flight forming the loop in which roller 7 is supported will increase in length. This sagging loop, however, is kept tensioned by the weight of roller 7 which swivels downward with the arms 17 as slack develops in the belt between rollers 2 and 3.

Since the lead of belt 1 passing beyond pressure roller 3 continues to be driven at unchanged speed with slipping over roller 4, the hanging loop in which roller 8 is supported will decrease in length, thus lifting roller 8 which is free to move upward with a swivelling of its arms 19. The weight of roller 8 keeps the belt tensioned in this loop.

While the powder image on belt 1 passes through the pressure zone between roller 3 and roller 25, the image is pressed into the soft rubber surface layer of belt 23 and in this way is transferred from belt 1 to belt 23 so as to be carried along by the latter. Although a very great part, typically 90 to 95%, of the image powder is transferred to belt 23 during this transfer, it generally is unavoidable that a residue of powder is left on belt 1. This residue is removed later in conventional manner by the operation of lamp 56 and brush 57.

The powder image transferred to belt 23 is heated from this belt while being carried along on it toward the second transfer station at rollers 24 and 27. During this heating the powder grains are softened and start coalescing, so that the image becomes sticky as it approaches the pressure roller 27.

In the meantime, the first friction roller 36 has been activated by the control system of the apparatus in order to feed a sheet from pile 35 to a position in which the leading edge of the sheet abuts against the stop means 44, and the cam 48 is subsequently rotated through an arc of 180° so that the arms 45 swivel upward and lift the stop means 44 out of the path of the sheet. The sheet supplied is then pushed forward by the rollers 40 and 41 and fed between belt 49 and plate 54, whereupon the sheet is transported further by belt 49. During this part of its travel the sheet is heated by contact with belt 49 so that, as the sheet approaches pressure roller 27, at least the side of the sheet which contacts belt 49 attains a temperature almost equal to the temperature of the image material being supplied on belt 23.

When the leading edge of the image present on belt 23 and the leading edge of the copy sheet being supplied along belt 49 come into the vicinity of roller 27, the cam 32 is rotated through an arc of 180°, causing the arms 29 to swivel about the axis of shaft 30 so that roller 27 is pressed against a portion of belt 23 supported against roller 24. Then the image on belt 23 and the sheet of copy material pass together through the pressure zone between roller 27 and roller 24, as a result of which the softened and sticky image material on belt 23 is pressed onto and adheres to the copy material. In this way, while passing the pressure zone between rollers 24 and 27, the whole image is separated from belt 23 and transferred to the copy material. Upon cooling, the transferred image will have firmly attached and thus become fixed to the copy material.

After an image formed on belt 1 has been transferred as above described to the belt 23 and from belt 23 to the copy sheet, the control system of the apparatus emits signals in response to which the cams 13, 32 and 48, and consequently also the rollers 3 and 27 and the stop means 44, are returned into their original positions. When the belt 1 on roller 3 is thus released from belt 23, the force exerted by the heavier floating roller 8, being greater than the force of the lighter floating roller 7, will cause the hanging loop engaged by roller 8 to increase in length while a corresponding decrease of length occurs in the loop engaged by roller 7. Roller 7 is thus moved upward until it reaches its limiting position determined by the arrest device 22. When it reaches that position, the two loops have regained exactly their original dimensions.

The speed with which the loops regain their original dimensions depends of course upon the difference between the forces exerted by the floating rollers, and upon the nature of belt 1. It has been observed, however, that with belts composed of paper or plastic films coated with a photoconductive layer, the difference mentioned and also the magnitudes of the forces exerted need not be great. For instance, in an apparatus according to the drawing in which belt 1 consisted of a Melinex film having a thickness of 0.1 mm and width of 400 mm, which was coated with a photoconductive ZnO/-binder layer having a thickness of 0.01 mm, a gradual and shock-free displacement of the loop forming belt material was obtained when roller 7 had a weight of 400–500 grams and the weight of roller 8 amounted to 800–1,000 grams.

The forces exercised by the floating rollers can of course be obtained in ways other than as indicated above. For instance, the greater force of roller 8 can be obtained by making its arms 19 heavier, instead of the roller itself, or can be derived from springs arranged to act on the arms 19. Further, it is not necessary that the floating rollers be supported in bearings in swivel arms; it is almost equally effective to support these rollers in bearings displaceably in slots, in such manner that the desired ratio of forces will be derived from the respective weights of the rollers with or without the aid of springs acting on the rollers.

In order to obtain copies of high quality it is necessary that each image be transferred to a sheet of the copy material in exact register. In the photocopying apparatus commonly used the attainment of such register requires that the control means be adjusted very precisely, and when the register must be changed or improved it is extremely difficult and often even impracticable to change the adjustment.

In the apparatus herein disclosed, given a certain adjustment of the control system, the register obtained between an image and a copy sheet is also determined by the dimension of the loop formed in the belt 1 by roller 7. This makes it possible to change or improve the register simply by displacing the arrest device 22. For that purpose, for instance, the arrest device 22 can be mounted slidably in a slot. It is advantageous, however, to provide the arrest device in the form of an eccentric cam as illustrated at 22*a* in FIG. 2 of the drawing, which cam may be connected with a turn knob easily accessible to an operator of the apparatus. By simply turning the cam 22*a* to an adjusted position the operator can select an increased or decreased distance between the locations of images on the belt 1 and the locations of the portions of this belt which are gripped against belt 23 when the roller 3 is pressed upward against roller 25.

The embodiment of the invention described above can of course be varied in many ways. For instance, the described image forming devices can be replaced by devices fulfilling the same functions but constructed differently. Also, the illustrated, rather short belt 1 can be replaced by a longer belt meandering over rollers, for instance, as disclosed in U.S. Pat. No. 4,077,713, or by an endless zig-zag folded belt as disclosed in U.S. Pat. No. 3,926,625. Moreover, it is only for exemplary purposes that the invention is described as embodied in an electrophotographic copying apparatus. The invention is similarly useful in copying apparatus based on another process, for instance electrography or magnetography, and/or in which images other than powder images, for instance liquid images or charge images, are formed and transferred.

What is claimed is:

1. In a copying apparatus comprising a belt which is movable forward to carry images on the belt to an image transfer zone, means spaced beyond said zone for guiding said belt, means spaced ahead of said zone for driving said belt at a substantially constant speed toward said zone, a movable intermediate support having a surface adapted to receive an image by transfer from said belt in said zone, means for moving said intermediate support forward at a speed slightly lower than the speed of said belt, means including a pressure device for bringing said belt in said zone into contact under pressure with said intermediate support so as to transfer an image from said belt to said intermediate support, during which contact the belt by friction locally accepts the speed of the intermediate support, means for supplying copy material into a second transfer zone adjacent to said intermediate support, and means for bringing the copy material into contact under pressure with the intermediate support in said second zone so as to transfer an image from the intermediate support to the copy material, the improvement which comprises a first floating roller engaging a lead of said belt between said belt driving means and said pressure device and exerting a first tensioning force on said belt lead, a second floating roller engaging a lead of said belt between said pressure device and said belt guiding means and exerting thereon a second belt tensioning force which is greater than said first tensioning force, and arrest means for limiting the displacement of said floating rollers in response to the greater force exerted by said second floating roller.

2. Copying apparatus according to claim 1, said arrest means cooperating with said first floating roller and being displaceable for adjustment of the length of belt in said lead between said belt driving means and said pressure device.

3. Copying apparatus according to claim 1 or 2, each of said floating rollers comprising freely rotatable narrow rollers which contact edge portions only of said belt.

4. Copying apparatus according to claim 1 or 2, each of said floating rollers being supported at its ends by freely pivotable arms.

5. Copying apparatus according to claim 1 or 2, said floating rollers forming and being supported in respective hanging loops of said belt leads and said forces being produced by the respective weights of said floating rollers.

6. Copying apparatus according to claim 3, each of said floating rollers being supported at its ends by freely pivotable arms.

7. Copying apparatus according to claim 3, said floating rollers forming and being supported in respective hanging loops of said belt leads and said forces being produced by the respective weights of said floating rollers.

8. Copying apparatus according to claim 4, said floating rollers forming and being supported in respective hanging loops of said belt leads and said forces being produced by the respective weights of said floating rollers.

* * * * *